US012560036B1

(12) United States Patent
Panari et al.

(10) Patent No.: US 12,560,036 B1
(45) Date of Patent: Feb. 24, 2026

(54) COILED TUBING DIMPLING TOOLS

(71) Applicant: Schlumberger Technology Corporation, Sugar Land, TX (US)

(72) Inventors: Mahesh Panari, Pune (IN); Saket Patel, Pune (IN); Mark Callister Oettli, Sugar Land, TX (US); Maxime Bouffe, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/924,653

(22) Filed: Oct. 23, 2024

(30) Foreign Application Priority Data

Aug. 23, 2024 (IN) ..... 202411063732

(51) Int. Cl.
*E21B 19/22* (2006.01)

(52) U.S. Cl.
CPC ..... *E21B 19/22* (2013.01)

(58) Field of Classification Search
CPC ..... E21B 17/026; E21B 17/04; E21B 17/20; E21B 17/046; E21B 17/041; E21B 17/043; E21B 17/0465; E21B 43/103; E21B 43/105; E21B 43/106; E21B 43/108; B21D 22/04; F16L 13/141
See application file for complete search history.

(56) References Cited

U.S. PATENT DOCUMENTS 3,453,831 A * 7/1969 Rusche ..... E02D 7/30 29/523
3,600,010 A * 8/1971 Downs, III ..... F16L 19/08 285/321
3,843,167 A * 10/1974 Gronstedt ..... F16L 37/002 285/123.6
3,860,270 A * 1/1975 Arnold ..... F16L 17/10 277/625
3,885,298 A * 5/1975 Pogonowski ..... B21D 41/02 29/523
4,319,393 A * 3/1982 Pogonowski ..... E21B 43/106 29/523
5,335,946 A * 8/1994 Dent ..... F16L 47/12 285/332

(Continued)

OTHER PUBLICATIONS

Hydraulic Dimpling Jig & Yoke, https://huntingplc.com/products-services/well-intervention-equipment/thru-tubing-technology/hydraulic-dimpling-jig-and-yoke/, Hunting, 3 pages.

*Primary Examiner* — Yanick A Akaragwe
(74) *Attorney, Agent, or Firm* — Jeffrey D. Frantz

(57) ABSTRACT

Systems and methods presented herein facilitate providing at least partially automated power for the purpose of forming dimples in coiled tubing. For example, a coiled tubing dimpling tool may include a cylindrical housing configured to receive and secure coiled tubing therein. The coiled tubing dimpling tool may also include one or more dimpling punches at least partially disposed in a wall of the cylindrical housing and configured to be pressed against the coiled tubing to form one or more dimples in the coiled tubing. The coiled tubing dimpling tool may further include an actuation mechanism configured to be actuated to generate at least a portion of a force used to cause the one or more dimpling punches to be pressed against the coiled tubing to form the one or more dimples in the coiled tubing.

18 Claims, 5 Drawing Sheets

(56) References Cited

U.S. PATENT DOCUMENTS

| | | | | |
|---|---|---|---|---|
| 6,474,701 | B1 * | 11/2002 | Bowles | F16L 13/141 285/256 |
| 7,861,776 | B2 * | 1/2011 | McKee | E21B 17/046 166/240 |
| 9,822,910 | B2 * | 11/2017 | Bowsher | F16L 21/08 |
| 2007/0068678 | A1 * | 3/2007 | McKee | E21B 19/16 166/384 |
| 2007/0235198 | A1 * | 10/2007 | Parker | E21B 17/046 166/380 |
| 2011/0095529 | A1 * | 4/2011 | Nicholson | F16L 37/138 285/382.7 |
| 2015/0060087 | A1 * | 3/2015 | Schultz | E21B 17/04 166/242.6 |

* cited by examiner

COILED TUBING DIMPLING TOOLS

BACKGROUND

The present disclosure generally relates to systems and methods for providing at least partially automated power for forming dimples in coiled tubing.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many well applications, coiled tubing is employed to facilitate performance of many types of downhole operations. Coiled tubing offers versatile technology due in part to its ability to pass through completion tubulars while conveying a wide array of tools downhole. A coiled tubing system may comprise many systems and components, including a coiled tubing reel, a coiled tubing pipe, an injector head, a gooseneck, lifting equipment (e.g., a mast or a crane), and other supporting equipment such as pumps, treating irons, or other components. Coiled tubing has been utilized for performing well treatment and/or well intervention operations in existing wellbores such as hydraulic fracturing operations, matrix acidizing operations, milling operations, perforating operations, coiled tubing drilling operations, and various other types of operations.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a coiled tubing dimpling tool that includes a cylindrical housing configured to receive and secure coiled tubing therein. The coiled tubing dimpling tool also includes one or more dimpling punches at least partially disposed in a wall of the cylindrical housing and configured to be pressed against the coiled tubing to form one or more dimples in the coiled tubing. The coiled tubing dimpling tool further includes an actuation mechanism configured to be actuated to generate at least a portion of a force used to cause the one or more dimpling punches to be pressed against the coiled tubing to form the one or more dimples in the coiled tubing.

Certain embodiments of the present disclosure also include a coiled tubing dimpling tool that includes a cylindrical housing configured to receive and secure coiled tubing therein. The coiled tubing dimpling tool also includes one or more dimpling punches at least partially disposed in a wall of the cylindrical housing and configured to be pressed against the coiled tubing to form one or more dimples in the coiled tubing. The coiled tubing dimpling tool further includes an actuation mechanism configured to be actuated to generate at least a portion of a force used to cause the one or more dimpling punches to be pressed against the coiled tubing to form the one or more dimples in the coiled tubing.

Certain embodiments of the present disclosure also include a coiled tubing dimpling tool that includes a cylindrical housing configured to receive and secure coiled tubing therein. The coiled tubing dimpling tool also includes one or more dimpling punches at least partially disposed in a wall of the cylindrical housing and configured to be pressed against the coiled tubing to form one or more dimples in the coiled tubing. The coiled tubing dimpling tool further includes a sleeve configured to slide axially relative to the cylindrical housing to apply a force against the one or more dimpling punches to cause the one or more dimpling punches to be pressed against the coiled tubing to form the one or more dimples in the coiled tubing. In addition, the coiled tubing dimpling tool includes a lead screw coupled to the cylindrical housing via threading between the lead screw and the cylindrical housing.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
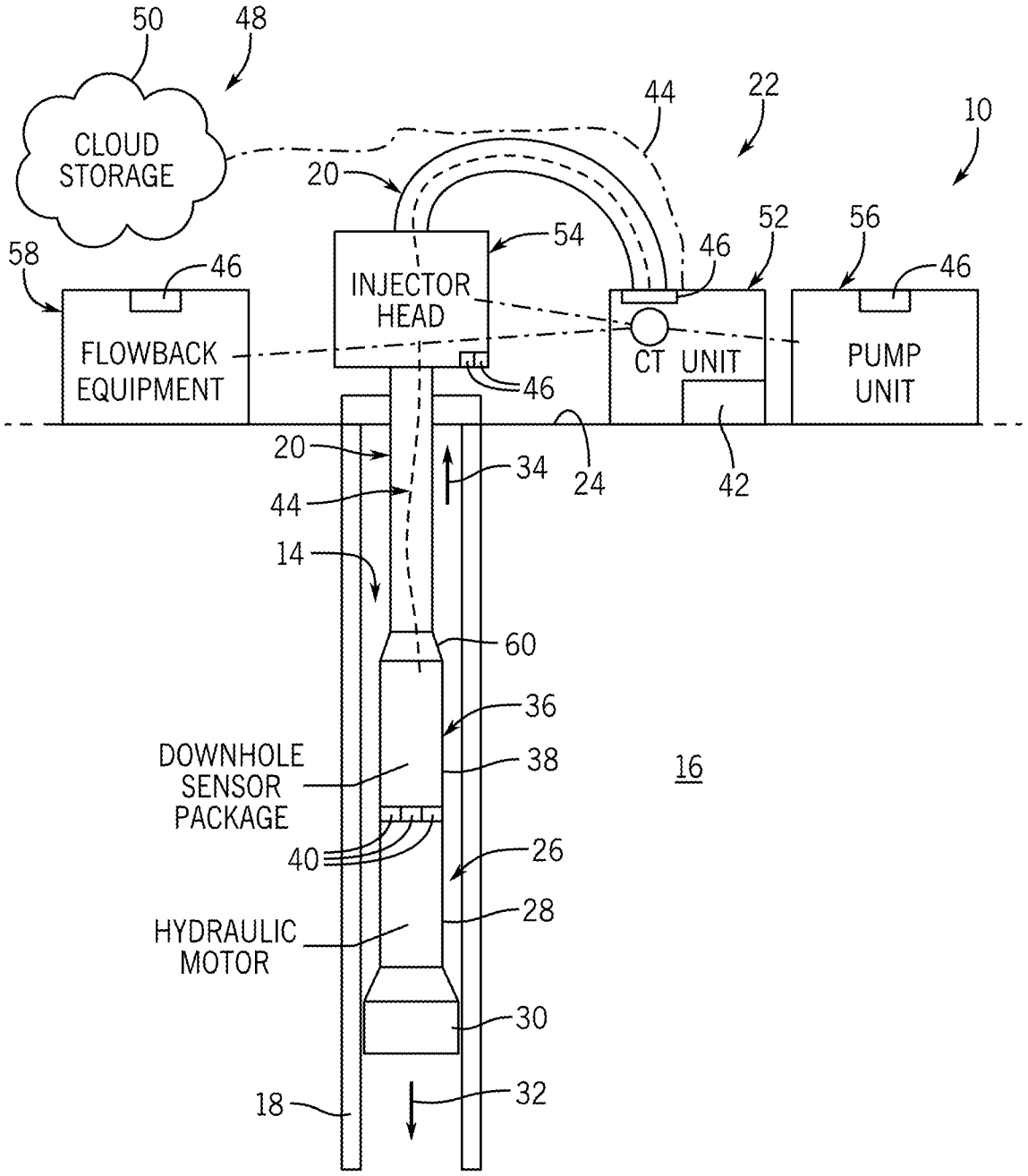
FIG. 1 illustrates a schematic diagram of an example coiled tubing system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or caused to be performed, for example, by a processing system (i.e., solely by the processing system, without human intervention). In addition, as used herein, the term "approximately equal to" may be used to mean values that are relatively close to each other (e.g., within 5%, within 2%, within 1%, within 0.5%, or even closer, of each other).

Dimple connectors are used to attach coiled tubing to bottom hole assemblies to meet the relatively high load capabilities for high torque and pulling applications. In general, to attach these dimple connectors to coiled tubing, dimples (e.g., projections) are made on an outer wall of the coiled tubing using a dimpling tool and associated dimpling punches. A coiled tubing connector may then be attached to an end of the coiled tubing by setscrews that engage with the preformed dimples.

Currently, dimpling of coiled tubing is a manual process, which involves manually screwing dimpling punches onto a wall of coiled tubing, thereby pushing the dimpling punches against the coiled tubing and leaving a projection on the wall of the coiled tubing. This process is relatively labor intensive, and generally needs to be performed every time coiled tubing is prepared for a coiled tubing operation. In addition, conventional dimpling of coiled tubing involves certain health, safety, and environment concerns, such as pinching of hands, objects falling from heights, manual lifting, and so forth, as there is a lot of manual intervention involved. Furthermore, such conventional dimpling of coiled tubing is relatively inefficient insofar as the time for the dimpling of coiled tubing may take more than three hours, in some instances.

The embodiments described herein are powered, for example, by hydraulics rather than manual power, which minimizes the HSE concerns described above. The dimpling tools described herein enable dimpling of multiple coil sizes with minimal human intervention and tool inventory. In addition, the dimpling tools described herein reduce the time required to perform dimpling of coiled tubing to approximately 15 minutes, as opposed to three hours using conventional dimpling techniques. The dimpling tools described herein reduce cost of service delivery and provide significant advantages over conventional dimpling techniques for interventions operations.

With the foregoing in mind, FIG. 1 illustrates a schematic diagram of an example coiled tubing (CT) system 10. As illustrated, in certain embodiments, a CT string 20 may be run into a wellbore 14 that traverses a hydrocarbon-bearing formation 16 (i.e., reservoir). While certain elements of the CT system 10 are illustrated in FIG. 1, other elements of the CT system 10 (e.g., blow-out preventers, wellhead "tree", etc.) may be omitted for clarity of illustration. In certain embodiments, the CT system 10 includes an interconnection of pipes, including vertical and/or horizontal casings 18, CT 20, and so forth, that connect to a surface facility 22 at the surface 24 of the CT system 10. In certain embodiments, the CT 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the CT 20. As illustrated in FIG. 1, in certain embodiments, the BHA 26 may include a downhole motor 28 that operates to rotate a drill bit 30 (e.g., during drilling operations) or other downhole tools. In certain embodiments, the downhole motor 28 may be driven by hydraulic forces carried in fluid supplied from the surface 24 of the CT system 10. In certain embodiments, the BHA 26 may be connected to the CT 20, which is used to run the BHA 26 to a desired location within the wellbore 14. It is also contemplated that, in certain embodiments, the rotary motion of the drill bit 30 may be driven by rotation of the CT 20 effectuated by a rotary table or other surface-located rotary actuator. In such embodiments, the downhole motor 28 may be omitted.

In certain embodiments, the CT 20 may also be used to deliver fluid 32 to the drill bit 30 through an interior of the CT 20 to aid in the drilling process and carry cuttings and possibly other fluid or solid components in return fluid 34 that flows up the annulus between the CT 20 and the casing 18 (or via a return flow path provided by the CT 20, in certain embodiments) for return to the surface facility 22. It is also contemplated that the return fluid 34 may include remnant proppant (e.g., sand) or possibly rock fragments that result from a hydraulic fracturing application, and flow within the CT system 10. Under certain conditions, fracturing fluid and possibly hydrocarbons (oil and/or gas), proppants and possibly rock fragments may flow from the fractured formation 16 through perforations in a newly opened interval and back to the surface 24 of the CT system 10 as part of the return fluid 34. In certain embodiments, the BHA 26 may be supplemented behind the rotary drill by an isolation device such as, for example, an inflatable packer that may be activated to isolate the zone below or above it and enable local pressure tests. In addition, in certain embodiments, the BHA 26 may include a tractor system that is capable of improving reach and WOB of the BHA 26 during CT operations.

As such, in certain embodiments, the CT system 10 may include a downhole well tool 36 that is moved along the wellbore 14 via the CT 20. In certain embodiments, the downhole well tool 36 may include a variety of drilling/cutting tools coupled with the CT 20. In the illustrated embodiment, the downhole well tool 36 includes the drill bit 30, which may be powered by the downhole motor 28 (e.g., a positive displacement motor (PDM), or other hydraulic motor) of the BHA 26. In certain embodiments, the wellbore 14 may be an openhole wellbore or a cased wellbore defined by the casing 18. In addition, in certain embodiments, the wellbore 14 may be vertical or horizontal or inclined. It should be noted the downhole well tool 36 may be part of various types of BHAs 26 coupled to the CT 20.

As also illustrated in FIG. 1, in certain embodiments, the CT system 10 may include a downhole sensor package 38 having multiple downhole sensors 40. In certain embodiments, the sensor package 38 may be mounted along the CT string 20, although certain downhole sensors 40 may be positioned at other downhole locations in other embodiments. In addition, in certain embodiments, downhole sensors 40 disposed on the CT 20. In certain embodiments, data from the downhole sensors 40 may be relayed uphole to a surface processing system 42 (e.g., a computer-based processing system) disposed at the surface 24 and/or other suitable location of the CT system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the CT 20, within a wall of the CT 20, or along an exterior of the CT 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

As illustrated, in certain embodiments, the CT 20 may deployed by a CT unit 52 and delivered downhole via an injector head 54. In certain embodiments, the injector head 54 may be controlled to slack off or pick up the CT 20 so as to control the tubing string weight and, thus, the weight-on-bit (WOB) acting on the drill bit 30 (or the downhole well tool 36). In certain embodiments, the downhole well tool 36 may be moved along the wellbore 14 via the CT 20 under control of the injector head 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, as described in greater detail herein, the data may be used to fully or partially automate downhole operations, to optimize the downhole operations, and/or to provide more accurate predictions regarding components or aspects of the downhole operations.

In certain embodiments, fluid 32 may be delivered downhole under pressure from a pump unit 56. In certain embodiments, the fluid 32 may be delivered by the pump unit 56 through the downhole motor 28 to power the downhole motor 28 and, thus, the drill bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including well treatment applications.

The CT unit 52, the injector head 54, the pump unit 56, and the flowback equipment 58 may include advanced surface sensors 46, actuators, and local controllers, such as PLCs, which may cooperate together to provide sensor data to receive control signals from, and generate local control signals based on communications with, respectively, the surface processing system 42. For example, in certain embodiments, surface sensors 46 of the CT unit 52 may be configured to detect positions of the CT 20, weights of the CT 20, and so forth. In addition, in certain embodiments, surface sensors 46 of the injector head 54 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluids production rates, solids production rates, and so forth.

In general, the CT 20 may be connected to the BHA 26 at a dimple connector 60 along the CT string 20. As described in greater detail herein, a dimpling tool may be used to create dimpling on the CT 20 to enable connection with the BHA 26 at the dimple connector 60. In particular, a dimpling tool, as described herein, may be located at the surface facility 22 to enable the CT 20 to be connected to the BHA 26 before running the CT string 20 into the wellbore 14 by, for example, creating dimpling on the CT 20 in an at least partially automated manner, as described in greater detail herein.

Figure 2:
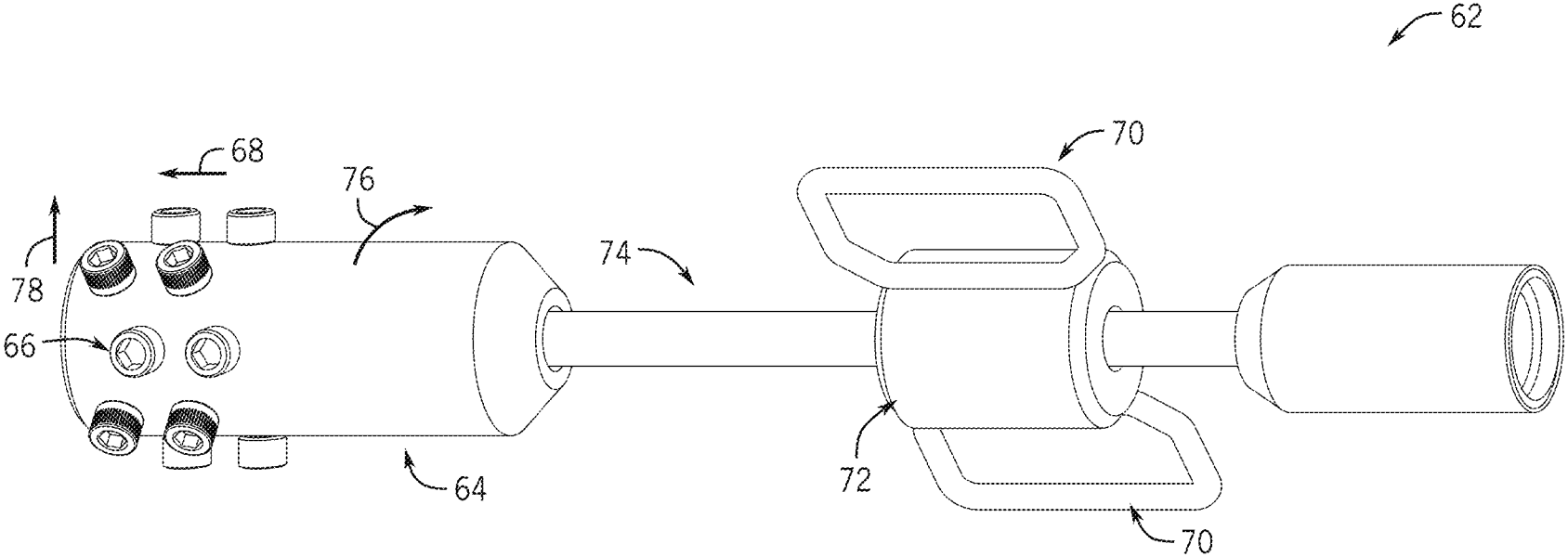
FIG. 2 illustrates an example manual coiled tubing dimpling tool that may be used by a field operator to manually create dimpling on coiled tubing.

As discussed above, conventional CT dimpling techniques involve manual processes whereby field operators use manual dimpling tools to create the dimpling on the coiled tubing. For example, FIG. 2 illustrates an example manual CT dimpling tool 62 that may be used by a field operator to manually create dimpling on coiled tubing. As illustrated in FIG. 2, the manual CT dimpling tool 62 may include a dimple body 64 that includes a plurality of dimple bolts 66 (or set screws). Once the manual CT dimpling tool 62 is inserted into coiled tubing, as illustrated by arrow 68, a field operator may manually use hand grips 70 of a slide hammer 72 of the manual CT dimpling tool 62 to push the manual CT dimpling tool 62 onto the pipe relative to a central rod 74 of the manual CT dimpling tool 62 if the pipe is not perfectly round, and to pull the manual CT dimpling tool 62 out of the pipe relative to the central rod 74 of the manual CT dimpling tool 62 once the dimpling is completed. Torque 76 applied on each dimple bolt 66 causes the respective dimple bolt 66 to extend radially from the dimple body 64, as illustrated by arrow 78, to provide force against an inner wall of the CT 20, thereby creating dimpling on the inner wall of the CT 20, which may interact with corresponding features of a BHA 26 to provide a connection between the CT 20 and the BHA 26.

Figure 3:
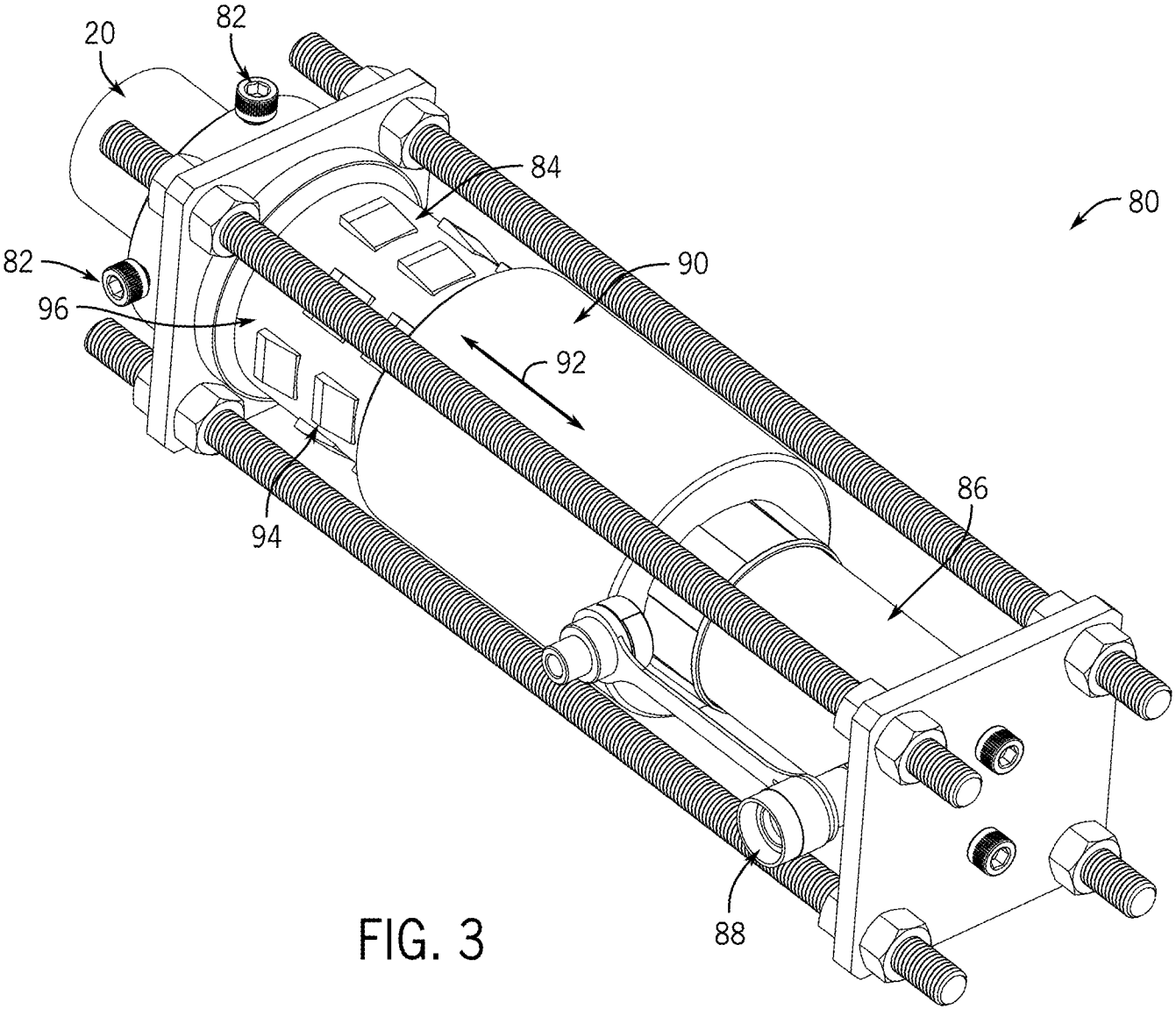
FIG. 3 illustrates an example coiled tubing dimpling tool that may be used to create dimples in coiled tubing, in accordance with embodiments of the present disclosure.

The embodiments described herein improve upon the manual dimpling process carried out using the example manual CT dimpling tool 62 illustrated in FIG. 2, as well as other conventional manual dimpling processes. For example, FIG. 3 illustrates an example CT dimpling tool 80 that may be used to create dimples in CT 20. As illustrated in FIG. 3, the CT dimpling tool 80 may first be attached to the CT 20, for example, with screws 82 and non-slip pads, among other attachment mechanisms, which are disposed on or adjacent a cylindrical housing 84 of the CT dimpling tool 80 into which the CT 20 is inserted.

Once the CT dimpling tool 80 has been attached to the CT 20, a hydraulic cylinder 86 of the CT dimpling tool 80 may be activated, for example, via hand or foot pump to provide hydraulic power to a hydraulic connection 88 of the hydraulic cylinder 86, until a full stroke of an associated sleeve 90 is completed, as illustrated by arrow 92. In this stroke, the sleeve 90 will slide axially relative to the cylindrical housing 84 such that a plurality of dimpling punches 94, each having tapered surfaces, are forced against an outer wall of the CT 20 to form dimples on the outer wall of the CT 20. As illustrated in FIG. 3, the plurality of dimpling punches 94 may be at least partially disposed within a wall 96 of the cylindrical housing 84 (e.g., and secured therein by appropriate securing mechanisms) such that forces applied against the dimpling punches 94 on an outer radial side of the wall 96 cause the dimpling punches 94 to be pressed against the CT 20 on an inner radial side of the wall 96.

As such, the process of forming the dimples on the outer wall of the CT 20 is completed in a single stroke. In contrast, in conventional manual dimpling techniques, an index of a position of the CT dimpling tool 80 does not need to be determined every time. Once all of the dimpling has been formed on the outer wall of the CT 20, the sleeve 90 may be returned back to its original position, and the CT dimpling tool 80 may be removed from the CT 20. As such, the CT dimpling tool 80 illustrated in FIG. 3 may be hydraulically powered such that the CT dimpling tool 80 can create the dimples on the outer wall of the CT 20 in an automated manner.

Although described with reference to FIG. 3 as including a hydraulic cylinder 86 as the actuation mechanism for generating at least a portion of the force used to cause the CT dimpling tool 80 to press the dimple bolts 66 (e.g., dimpling punches) against the CT 20 to form dimples in the CT 20, in other embodiments, other types of actuation mechanisms, such as pneumatic actuation mechanisms (e.g., pneumatic cylinders), electrical actuation mechanisms, and so forth, may instead be used.

Figure 4:
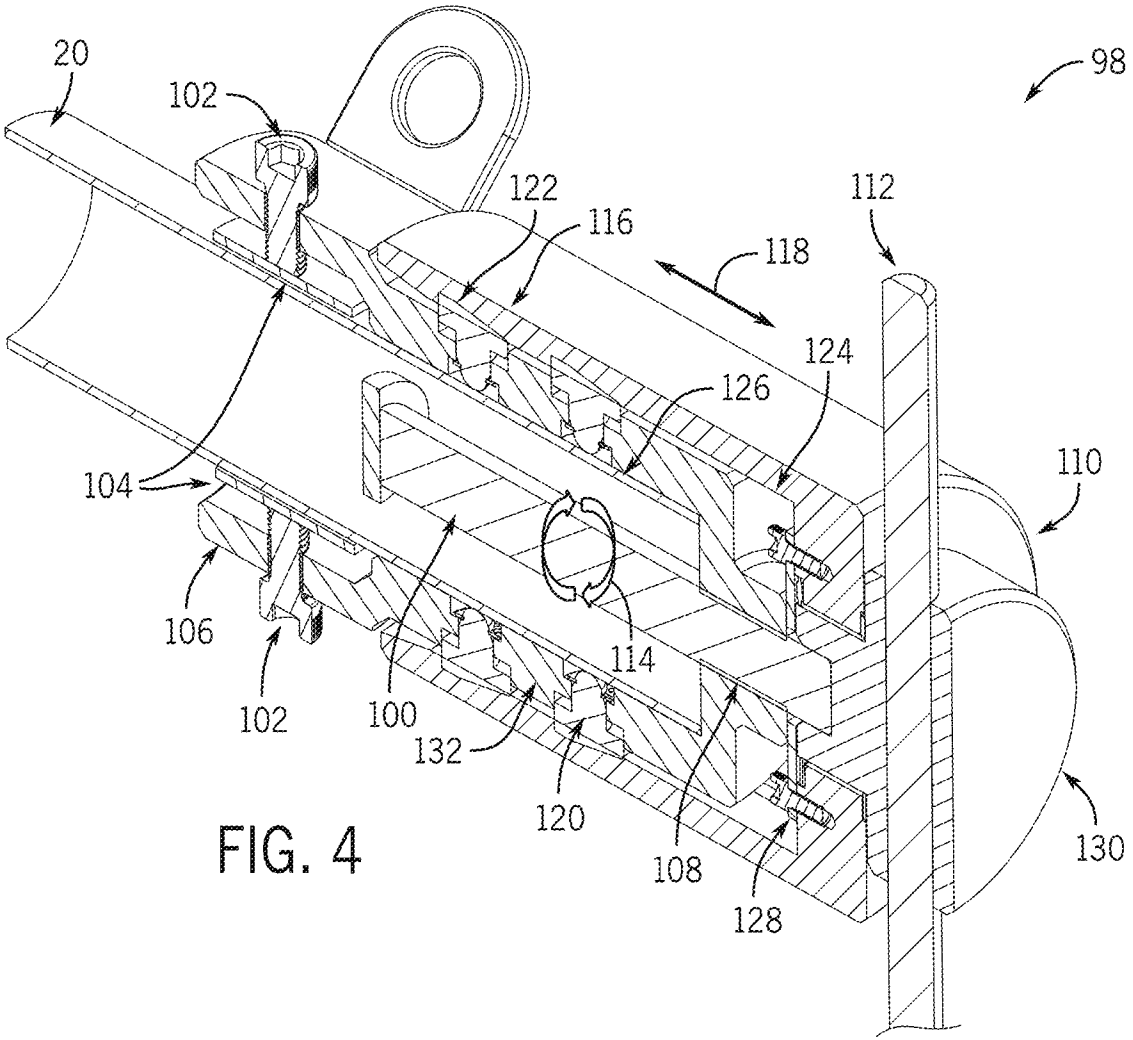
FIG. 4 illustrates another example coiled tubing dimpling tool that may be used to create dimples in coiled tubing, in accordance with embodiments of the present disclosure.

FIG. 4 illustrates another example CT dimpling tool 98 that may be used to create dimples in CT 20. In contrast to the embodiment illustrated in FIG. 3, the CT dimpling tool 98 illustrated in FIG. 4 is not hydraulically powered but rather is actuated by a lead screw 100. As discussed above, the CT dimpling tool 98 may first be attached to the CT 20, for example, with screws 102 and non-slip pads 104, among other attachment mechanisms, which are disposed on or adjacent a cylindrical housing 106 of the CT dimpling tool 98 into which the CT 20 is inserted, and to which the lead screw 100 is coupled via threading 108 between the lead screw 100 and the cylindrical housing 106.

In this embodiment, manual torque may be applied at an axial end 110 of the CT dimpling tool 98 by a field operator manually manipulating a torque bar 112 of the CT dimpling tool 98. The torque applied via the torque bar 112 gradually rotates the lead screw 100 of the CT dimpling tool 98, as illustrated by arrows 114, until a full stroke of an associated sleeve 116 is completed, as illustrated by arrow 118. In this stroke, the sleeve 116 will slide axially relative to the cylindrical housing 106 such that a plurality of dimpling punches 120, each interacting via tapered surfaces 122 on an inner wall 124 of the sleeve 116, are forced against an outer wall 126 of the CT 20 to form dimples on the outer wall 126 of the CT 20. In certain embodiments, a thrust bearing 128 (e.g., a needle roller thrust bearing) may be disposed between the cylindrical housing 106 and a torque transfer body 130 coupled to the torque bar 112 that is used to transfer torque from the torque bar 112.

As such, the process of forming the dimples on the outer wall 126 of the CT 20 is completed in a single stroke. As discussed above, in contrast, in conventional manual dimpling techniques, an index of a position of the dimpling tool needs to be determined every time. Once all of the dimpling has been formed on the outer wall 126 of the CT 20, the sleeve 116 may be returned back to its original position, and the CT dimpling tool 98 may be removed from the CT 20. As such, the CT dimpling tool 98 illustrated in FIG. 4 is manually actuated, However, in contrast to conventional dimpling techniques, the amount of time required by a field operator is reduced significantly insofar because of the design of the CT dimpling tool 98.

It is noted that, similar to the embodiment illustrated in FIG. 3, the plurality of dimpling punches 120 may be at least partially disposed within a wall 132 of the cylindrical housing 106 (e.g., and secured therein by appropriate securing mechanisms) such that forces applied against the dimpling punches 120 on an outer radial side of the wall 132 cause the dimpling punches 120 to be pressed against the CT 20 on an inner radial side of the wall 132.

Figure 5A:
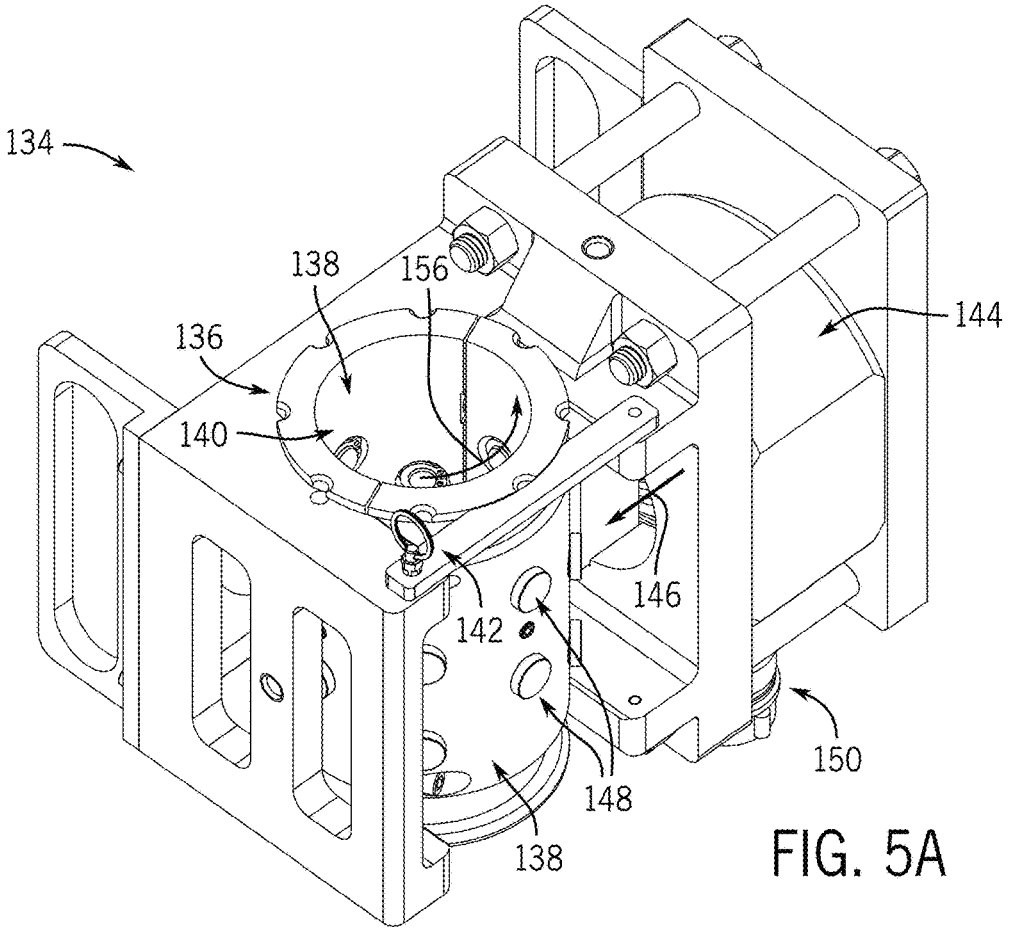
FIGS. 5A and 5B illustrate another example coiled tubing dimpling tool that may be used to create dimples in coiled tubing, in accordance with embodiments of the present disclosure.
Figure 5B:
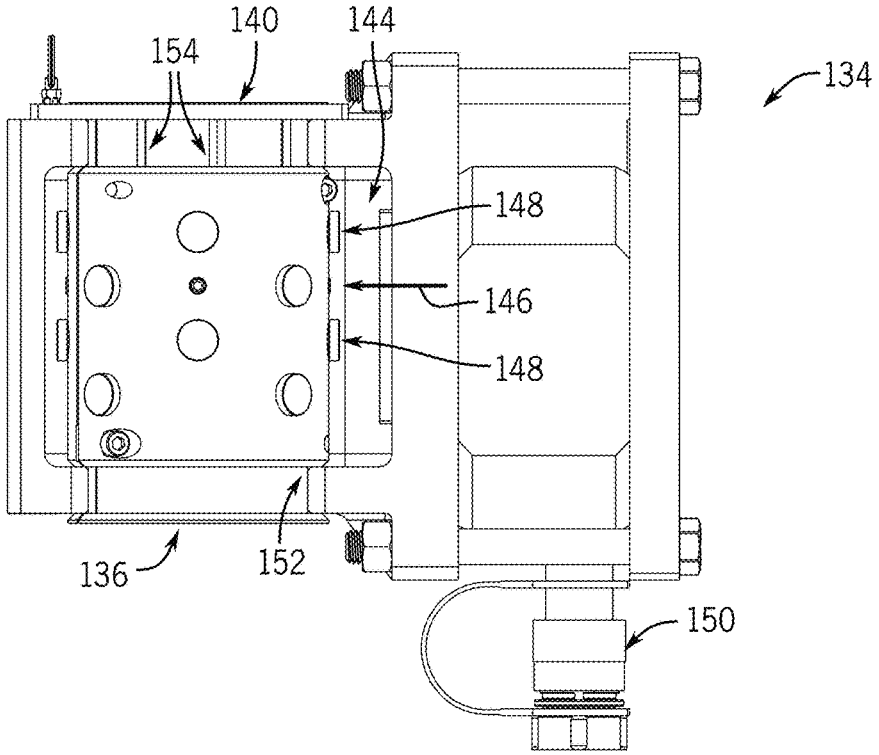

FIGS. 5A and 5B illustrate another example CT dimpling tool 134 that may be used to create dimples in CT 20. As illustrated in FIGS. 5A and 5B, the CT dimpling tool 134 may include a yoke 136 within which the CT 20 may be inserted. Once the CT 20 has been inserted into the yoke 136, split halves 138 of the yoke 136 may be pressed together, for example, by tightening flange portions 140 of the split halves 138 via a yoke securing arm 142, as illustrated in FIG. 5, thereby attaching the CT dimpling tool 134 to the CT 20.

Once the CT dimpling tool 134 has been attached to the CT 20, a hydraulic ram 144 disposed radially adjacent the yoke 136 may apply a radial force against the yoke 136, as illustrated by arrows 146, thereby pressing dimpling punches 148 against the CT 20 to form dimples in the CT 20. More specifically, in certain embodiments, hydraulic power may be provided to the hydraulic ram 144 via a hydraulic connection 150.

It is noted that, similar to the embodiments illustrated in FIGS. 3 and 4, the plurality of dimpling punches 148 may be at least partially disposed within walls 152 of the split halves 138 of the yoke 136 collectively functioning as a cylindrical housing (e.g., and secured therein by appropriate securing mechanisms) such that forces applied against the dimpling punches 148 on an outer radial side of the walls 152 cause the dimpling punches 148 to be pressed against the CT 20 on an inner radial side of the walls 152.

As illustrated in FIG. 5, in certain embodiments, the split halves 138 of the yoke 136 may include indexing features 154 to enable the dimpling punches 148 to be indexed at a correct circumferential location about the CT 20. For example, in the embodiment illustrated in FIG. 5, the indexing features 154 may include slots that extend longitudinally along the split halves 138 of the yoke 136. However, in other embodiments, other types of indexing features 154 may be used. In general, once a set of dimples have been formed on the CT 20 while the yoke 136 is oriented at a first circumferential position, the yoke 136 may then be rotated, as illustrated by arrow 156, to a second circumferential position, at which another set of dimples may be formed on the CT 20 by application of hydraulic force applied by the hydraulic ram 144.

As such, similar to the embodiment illustrated in FIG. 3, the CT dimpling tool 134 illustrated in FIG. 5 is hydraulically powered such that the CT dimpling tool 134 can create the dimples on the outer wall of the CT 20 in an automated manner. Another advantage of the embodiment illustrated in FIG. 5 is that, in some instances, cables (e.g., fiber optic cables) may be physically coupled at an axial end of the CT 20 on which dimples are to be formed, and CT dimpling tool 134 helps alleviate such issues in a manner that the embodiments illustrated in FIGS. 3 and 4 do not. Specifically, since the dimple-forming forces are applied against the CT 20 from a hydraulic ram 144 located radially relative to the CT 20 (e.g., as opposed to be located axially relative to the CT 20) while the dimples are being formed, such cables can simply be fed through the split halves 138 of the yoke 136 during the dimpling process. In contrast, it will be appreciated that such cables would have no such open space within which to pass in the embodiments illustrated in FIGS. 3 and 4. While additional spaces could be introduced in the embodiments illustrated in FIGS. 3 and 4, it will be appreciated that the embodiment illustrated in FIG. 5 much more readily accommodates the presence of such cables. Furthermore, the design of the CT dimpling tool 134 also facilitates the forming dimples on the CT 20 at various longitudinal positions along the CT 20 insofar as the CT 20 can simple be moved to different longitudinal positions within the split halves 138 of the yoke 136 for dimpling via the hydraulic ram 144.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A coiled tubing dimpling tool, comprising:
- a cylindrical housing configured to receive and secure coiled tubing therein;
- one or more dimpling punches at least partially disposed in a wall of the cylindrical housing and configured to be pressed against the coiled tubing to form one or more dimples in the coiled tubing;
- a sleeve configured to slide axially relative to the cylindrical housing to apply a force against the one or more dimpling punches to cause the one or more dimpling punches to be pressed against the coiled tubing to form the one or more dimples in the coiled tubing; and
- an actuation mechanism configured to be actuated to generate at least a portion of a force used to cause the one or more dimpling punches to be pressed against the coiled tubing to form the one or more dimples in the coiled tubing.

2. The coiled tubing dimpling tool of claim 1, wherein each dimpling punch of the one or more dimpling punches comprises a tapered surface configured to be contacted by the sleeve as the sleeve slides axially relative to the cylindrical housing.

3. The coiled tubing dimpling tool of claim 1, wherein the sleeve comprises a plurality of tapered surfaces on an inner wall of the sleeve configured to contact respective dimpling punches of the one or more dimpling punches as the sleeve slides axially relative to the cylindrical housing.

4. The coiled tubing dimpling tool of claim 1, wherein the actuation mechanism comprises a hydraulic cylinder configured to cause the sleeve to slide axially relative to the cylindrical housing.

5. The coiled tubing dimpling tool of claim 1, wherein the actuation mechanism comprises a pneumatic cylinder configured to cause the sleeve to slide axially relative to the cylindrical housing.

6. The coiled tubing dimpling tool of claim 1, wherein the actuation mechanism comprises an electrical actuation mechanism configured to cause the sleeve to slide axially relative to the cylindrical housing.

7. The coiled tubing dimpling tool of claim 1, wherein the actuation mechanism comprises a lead screw coupled to the cylindrical housing via threading between the lead screw and the cylindrical housing.

8. The coiled tubing dimpling tool of claim 7, wherein the actuation mechanism comprises a torque bar coupled to the lead screw via a torque transfer body.

9. The coiled tubing dimpling tool of claim 8, wherein the torque bar is configured to be manually rotated relative to the cylindrical housing to cause the sleeve to slide axially relative to the cylindrical housing.

10. A coiled tubing dimpling tool, comprising:
- a cylindrical housing configured to receive and secure coiled tubing therein;
- one or more dimpling punches at least partially disposed in a wall of the cylindrical housing and configured to be pressed against the coiled tubing to form one or more dimples in the coiled tubing;
- a sleeve configured to slide axially relative to the cylindrical housing to apply a force against the one or more dimpling punches to cause the one or more dimpling punches to be pressed against the coiled tubing to form the one or more dimples in the coiled tubing; and
- an actuation mechanism configured to be actuated to generate at least a portion of a force used to cause the one or more dimpling punches to be pressed against the coiled tubing to form the one or more dimples in the coiled tubing.

11. The coiled tubing dimpling tool of claim 10, wherein each dimpling punch of the one or more dimpling punches comprises a tapered surface configured to be contacted by the sleeve as the sleeve slides axially relative to the cylindrical housing.

12. The coiled tubing dimpling tool of claim 10, wherein the actuation mechanism comprises a hydraulic cylinder configured to cause the sleeve to slide axially relative to the cylindrical housing.

13. The coiled tubing dimpling tool of claim 10, wherein the actuation mechanism comprises a pneumatic cylinder configured to cause the sleeve to slide axially relative to the cylindrical housing.

14. The coiled tubing dimpling tool of claim 10, wherein the actuation mechanism comprises an electrical actuation mechanism configured to cause the sleeve to slide axially relative to the cylindrical housing.

15. A coiled tubing dimpling tool, comprising:

a cylindrical housing configured to receive and secure coiled tubing therein;

one or more dimpling punches at least partially disposed in a wall of the cylindrical housing and configured to be pressed against the coiled tubing to form one or more dimples in the coiled tubing;

a sleeve configured to slide axially relative to the cylindrical housing to apply a force against the one or more dimpling punches to cause the one or more dimpling punches to be pressed against the coiled tubing to form the one or more dimples in the coiled tubing; and a lead screw coupled to the cylindrical housing via threading between the lead screw and the cylindrical housing.

16. The coiled tubing dimpling tool of claim 15, comprising a torque bar coupled to the lead screw via a torque transfer body.

17. The coiled tubing dimpling tool of claim 16, wherein the torque bar is configured to be manually rotated relative to the cylindrical housing to cause the sleeve to slide axially relative to the cylindrical housing.

18. The coiled tubing dimpling tool of claim 16, comprising a thrust bearing disposed between the cylindrical housing and the torque transfer body to transfer torque from the torque bar.

* * * * *